US007551863B2

(12) United States Patent
Takahashi

(10) Patent No.: US 7,551,863 B2
(45) Date of Patent: Jun. 23, 2009

(54) IMAGE FORMING APPARATUS HAVING A CLEANING UNIT FOR COLLECTING WASTE TONER

(75) Inventor: Osamu Takahashi, Nagoya (JP)

(73) Assignee: Brother Kogyo Kabushiki Kaisha, Nagoya-shi, Aichi (JP)

( * ) Notice: Subject to any disclaimer, the term of this patent is extended or adjusted under 35 U.S.C. 154(b) by 169 days.

(21) Appl. No.: 11/689,867

(22) Filed: Mar. 22, 2007

(65) Prior Publication Data

US 2007/0230976 A1 Oct. 4, 2007

(30) Foreign Application Priority Data

Mar. 29, 2006 (JP) ..... 2006-092115

(51) Int. Cl.
*G03G 15/00* (2006.01)
*G03G 21/00* (2006.01)
*G03G 21/12* (2006.01)

(52) U.S. Cl. ..... 399/35; 399/71; 399/72

(58) Field of Classification Search ..... 399/35, 399/34, 71, 72, 49, 98, 43
See application file for complete search history.

(56) References Cited

U.S. PATENT DOCUMENTS

| | | | | |
|---|---|---|---|---|
| 6,122,461 | A * | 9/2000 | Shinohara | 399/43 |
| 7,024,127 | B2 * | 4/2006 | Hisakuni | 399/71 |
| 2005/0238370 | A1 * | 10/2005 | Kameda | 399/35 |
| 2007/0201887 | A1 * | 8/2007 | Shakui | 399/34 |
| 2008/0002997 | A1 * | 1/2008 | Watanabe et al. | 399/35 |

FOREIGN PATENT DOCUMENTS

| | | |
|---|---|---|
| JP | 2003-149905 | 5/2003 |
| JP | 2003-202713 | 7/2003 |
| JP | 2004-101667 | 4/2004 |
| JP | 2005-122341 | 5/2005 |
| JP | 2005-227615 | 8/2005 |

* cited by examiner

*Primary Examiner*—Sophia S Chen
(74) *Attorney, Agent, or Firm*—Banner & Witcoff, Ltd.

(57) ABSTRACT

An image forming apparatus includes an image carrier, a cleaning unit that collects a waste toner that remains on the image carrier, a toner container that stores the waste toner collected by the cleaning unit, a determination unit that determines whether the waste toner stored in the toner container reaches a predetermined storage level that is lower than a maximum storage level of the toner container, and a control unit that executes a control of suppressing generation of the waste toner when the determination unit determines that the waste toner has reached the predetermined storage level.

20 Claims, 16 Drawing Sheets

IMAGE FORMING APPARATUS HAVING A CLEANING UNIT FOR COLLECTING WASTE TONER

CROSS REFERENCE TO RELATED APPLICATION

This application claims priority from Japanese Patent Application No. 2006-92115 filed Mar. 29, 2006. The entire content of this priority application is incorporated herein by reference.

TECHNICAL FIELD

The disclosure relates to an image forming apparatus.

BACKGROUND

When a paper jam occurs in an image forming apparatus, toner may be left on components such as a photoconductor, a conveyor belt or an intermediate transfer belt without being transferred onto a sheet. When the density of a transfer image is adjusted in the image forming apparatus, the density pattern is formed on the photoconductor and then transferred onto the conveyor belt for the measurement of its density. In this case, the toner of the density pattern on the conveyor belt needs to be removed after the measurement. A proposed solution to this has been to include a mechanism to remove the toner left on the photoconductor or the like when the paper jam occurs or the toner of the above density pattern, from the photoconductor, the conveyor belt, the intermediate transfer belt, or the like, and to collect the toner in the waste toner container.

When the image forming is continuously performed even after the toner collected in the toner container reaches the maximum storage level, the waste toner cannot be collected appropriately. This may cause a toner leakage, resulting in malfunction in the image forming apparatus.

The image forming apparatus disclosed in Japanese Patent Application Publication No. JP-A-2004-101667 is designed to stop the image forming operation when the waste toner collected in the toner container (waste toner box) reaches the maximum storage level so as to prevent the toner leakage or the like that causes malfunction in the image forming apparatus.

Once the waste toner collected in the toner container reaches the maximum storage level, further image forming operation thereafter is undesirable, and therefore, the operation has to be stopped. If the timing at which the waste toner is about to reach the maximum storage level is known to the user in advance, it is possible for the user to try to delay the timing at which the waste toner collected in the toner container reaches the maximum storage level by reducing the number of the image forming operations so that the image forming apparatus can be used as long as possible. However, this may put a considerable strain on the user.

In view of the aforementioned circumstances, there is a need for a technique that delays the timing at which the waste toner collected in the toner container of the image forming apparatus reaches the maximum storage level without increasing the strain on the user.

SUMMARY

According to one aspect of the present invention, an image forming apparatus can include an image carrier, a cleaning unit that collects a waste toner left on said image carrier, a toner container that stores said waste toner collected by said cleaning unit, a determination unit that determines whether said waste toner stored in said toner container reaches a predetermined storage level that is lower than a maximum storage level of said toner container, and a control unit that executes a control of suppressing generation of said waste toner when said determination unit determines that said waste toner has reached said predetermined storage level.

According to the present invention, the control of suppressing generation of the waste toner is executed when it is determined that the waste toner reaches the predetermined storage level that is lower than the maximum storage level. This makes it possible to delay the timing at which the waste toner collected in the toner container reaches the maximum storage level without increasing the strain on the user.

Note that the term "waste toner" denotes the toner which is fed in the image processing apparatus but not consumed for forming the image on the recording medium such as the sheet. The waste toner includes, for example, the toner used for the density pattern formed on the conveyor belt upon correction of the density of the image, the toner used for the pattern formed on the conveyor belt upon correction of the image forming position for each color in the color image forming apparatus, and the toner left on the image carrier (photoconductor, conveyor belt, the intermediate transfer belt or the like) after the image forming operation.

BRIEF DESCRIPTION OF THE DRAWINGS

Illustrative aspects in accordance with the present invention will be described in detail with reference to the following figures wherein.

DETAILED DESCRIPTION

A laser printer (an exemplary "image forming apparatus") according to an aspect of the present invention will be described referring to FIGS. 1 to 10.

1. Laser Printer (1) Overall Structure

Figure 1:
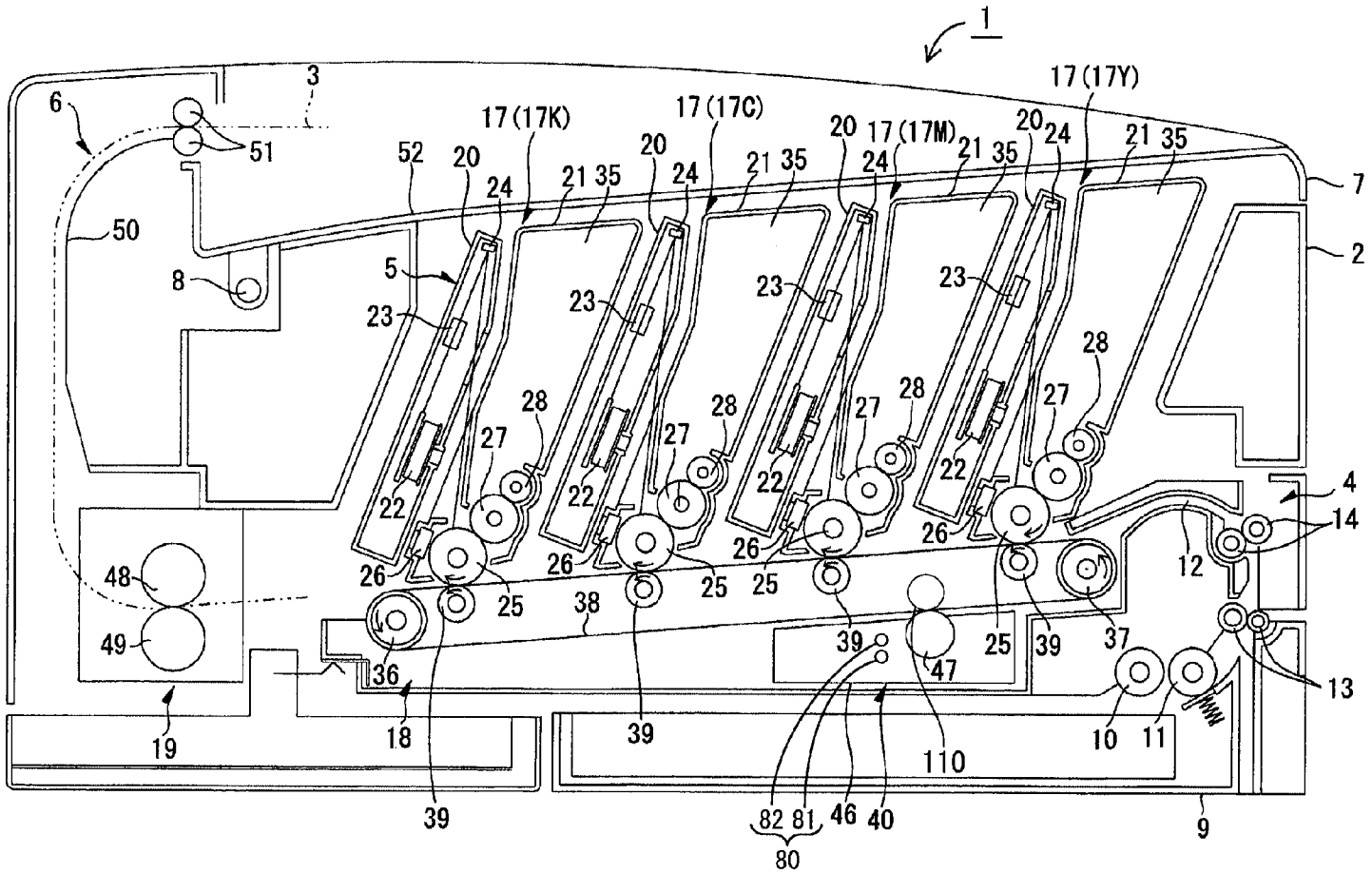
FIG. 1 is a sectional side elevation schematically showing a laser printer according to one aspect of the present invention.

FIG. 1 is a sectional side elevation of a laser printer.

A color laser printer 1 is of horizontal type where a plurality of process units 17 are arranged in parallel in the horizontal direction, and includes a feeder 4 that feeds a recording medium 3, such as a sheet of paper, an image forming unit 5 for forming an image on the recording medium 3 which has been fed, and a discharge unit 6 that discharges the recording medium 3 on which the image is formed within a body casing 2.

The body casing 2 has a box-like shape with an open upper portion on which a top cover 7 is set. The top cover 7 is rotatably supported via a cover shaft 8 at the rear side of the body casing 2 (hereinafter, the left and right sides in FIG. 2 will be referred to as the rear and front sides of the printer 1, respectively) so as to be freely opened and closed with respect to the body casing 2.

The feeder 4 includes a feeder tray 9 disposed on the bottom of the body casing 2, a pickup roller 10 and a feeder roller 11 to the upper front of the feeder tray 9, a U-shaped path 12 disposed to the upper front of the feeder roller 11, a pair of conveyor rollers 13 and a pair of registration rollers 14 at halfway of the U-shaped path 12.

The feeder tray 9 may be pulled forward of the printer 1 and is configured to store a stack of the recording media 3. The top of the stack of the recording media 3 is picked up by the pickup roller 10 and carried forward, and fed to the U-shaped path 12 by the feeder roller 11. The recording medium 3 on the U-shaped path 12 is fed through the conveyor rollers 13 such that the conveying direction is inverted like U-shape. It is subjected to registration by the registration rollers 14 and fed rearward therethrough.

The image forming unit 5 includes process units 17, a transfer unit 18, and a fixation unit 19.

The process units 17 are formed of four units, that is, a yellow process unit 17Y, a magenta process unit 17M, a cyan process unit 17C and a black process unit 17K. Those process units 17 are arranged in substantially a horizontal direction in parallel at predetermined intervals.

Each of the process units 17 includes a scanner unit 20 and a process cartridge 21.

In the scanner unit 20, the laser beam emitted from a laser emitting portion (not shown) based on the image data is reflected on a polygon mirror 22 to transmit a lens 23, and is then reflected on a reflecting mirror 24 so as to be emitted toward each photoconductor drum 25 to be described later.

The process cartridge 21 includes the photoconductor drum 25 as an exemplary photoconductor, a charger unit 26, a development roller 27 and a feed roller 28.

The charger unit 26 is a positively charged scorotron charger that is equipped with a wire and a grid and that generates the corona discharge. The charger unit 26 is disposed opposite the photoconductor drum 25 to the rear thereof so as not to be in contact therewith.

The development roller 27 is in press contact with the upper portion of the photoconductor drum 25.

The feed roller 28 is in press contact with the upper portion of the development roller 27.

A toner storage chamber 35 is formed at the upper portion of the process cartridge 21 for containing the toner corresponding to the respective colors. That is, the toner storage chambers 35 contain yellow toner, magenta toner, cyan toner and black toner corresponding to the yellow process unit 17Y, the magenta process unit 17M, the cyan process unit 17C, and the black process unit 17B, respectively.

In the process unit 17, during the image forming operation to the recording medium 3, the toner corresponding to each color stored in the corresponding toner container 35 is fed to the feed roller 28, and further fed to the development roller 27 due to the rotation of the feed roller 28. At this time, the toner is positively friction charged between the feed roller 28 and the development roller 27 to which a development bias is applied.

Meanwhile, the charge bias is applied to the charger unit 26 to generate the corona discharge such that the surface of the photoconductor drum 25 is positively charged uniformly. The surface of the photoconductor drum 25 is uniformly positively charged by the charger unit 26 due to the rotation of the photoconductor 25, and exposed through the high speed scan of the laser beam emitted from the scanner unit 20 to form an electrostatic latent image corresponding to the image to be formed on the recording medium 3.

As the photoconductor drum 25 further rotates, the positively charged toner carried on the surface of the development roller 27 is fed to the electrostatic latent image formed on the surface of the photoconductor drum 25 when the rotation of the development roller 27 brings the toner into contact with the opposite photoconductor drum 25. As a result, the electrostatic latent image on the photoconductor drum 25 is visualized, and the toner images of the respective colors are carried on the surface of the photoconductor drum 25.

The transfer unit 18 is disposed at the upper portion of the feeder unit 4 within the body casing 2, and arranged in the front-to-rear direction below the process units 17. The transfer unit 18 is provided with a drive roller 36, a driven roller 37, a conveyor belt 38, transfer rollers 39 and a belt cleaning unit 40.

The conveyor belt 38 (exemplary "image carrier" in the present invention) is an endless belt and formed of a resin material including conductive polycarbonate, polyimide, or the like, having the conductive particles such as carbon dispersed. The conveyor belt 38 is wound around the drive roller 36 and the driven roller 37 to extend therebetween.

The transfer rollers 39 are disposed inside the conveyor belt 38 such that the conveyor belt 38 is sandwiched between the transfer rollers 39 and the photoconductor drums 25 of the respective process units 17. The transfer bias is applied to those transfer rollers 39.

The belt cleaning unit 40 is disposed below the conveyor belt 38 in a relatively large space toward the driven roller 37. The belt cleaning unit 40 includes a toner container 46 and a cleaning roller 47 (exemplary "cleaning unit").

A backup roller 110 that faces the cleaning roller 47 is disposed inside the conveyor belt 38.

The fixation unit 19 includes a heat roller 48 and a pressure roller 49 and is disposed to the rear of the transfer unit 18. The color image transferred onto the recording medium 3 is heat fixed while the recording medium is passing between the heat roller 48 and the pressure roller 49.

The discharge unit 6 includes a U-shaped path 50, discharge rollers 51, and a catch tray 52.

The U-shaped path 50 is formed into a substantially U-like shape as the path for carrying the recording medium 3, which has an end at the upstream side adjacent to the fixation unit 19 at the lower portion such that the recording medium 3 is fed rearward, and an end at the downstream side adjacent to the catch tray 52 at the upper portion such that the recording medium 3 is discharged forward.

The sheet carried from the fixation unit 19 is further fed to the U-shaped path 50 where the conveying direction is inverted such that the sheet is discharged forward onto the catch tray 52 by the discharge rollers 51.

(2) Electric Structure

Figure 2:
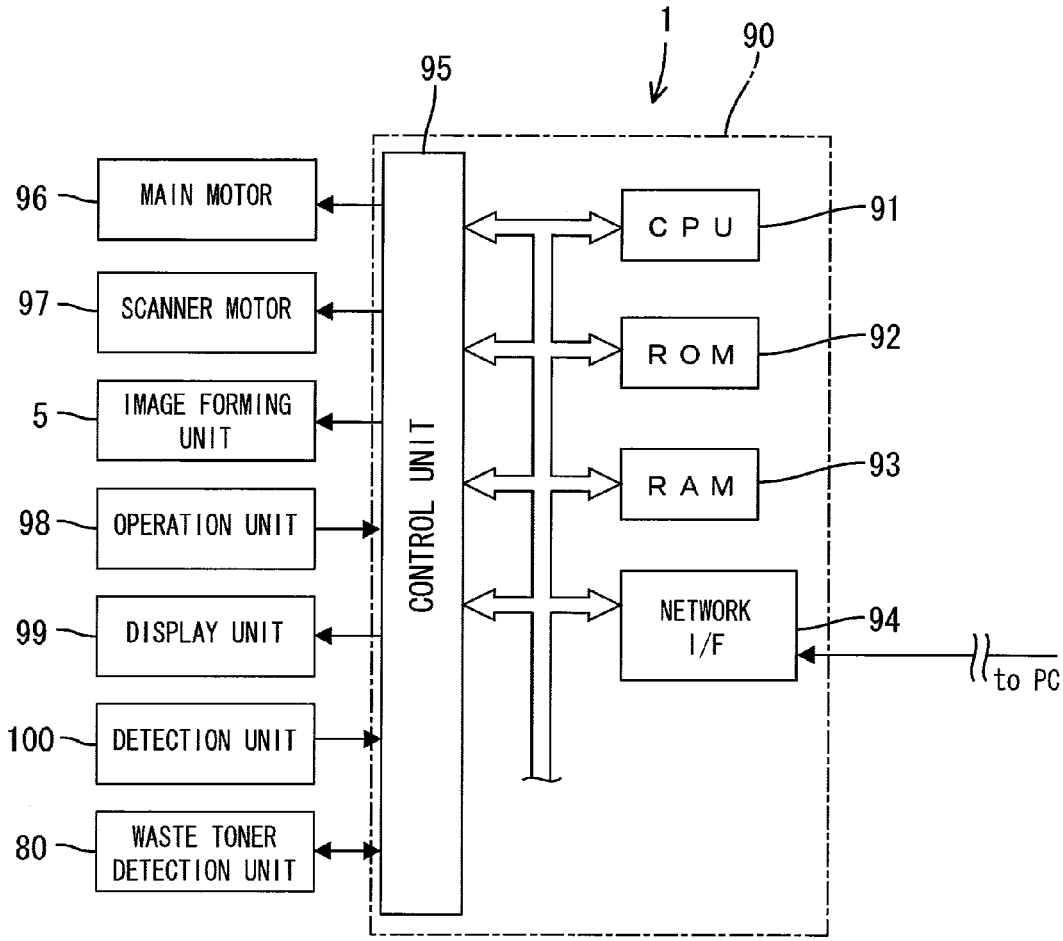
FIG. 2 is a block diagram of an electric structure of the laser printer.

The electric structure of the aforementioned laser printer will be described. FIG. 2 is a block diagram showing the electric structure of the laser printer.

As shown in FIG. 2, the printer 1 includes a control system 90 that controls various components. The control system 90 includes a CPU 91, a ROM 92, a RAM 93, a network interface 94, and a control unit 95. The control unit 95 is formed of Application Specific Integrated Circuit (ASIC). The control unit 95 is connected to a main motor 96, a scanner motor 97, an image forming unit 5 (exemplary "pattern forming unit"), an operation unit 98, a display unit 99 (exemplary "display unit"), a detection unit 100, and a toner detection unit 80. The operation unit 98 is formed of an input panel, the display unit 99 is formed of various types of the lamp and an LCD, and the detection unit 100 is formed of various types of sensor. The toner detection unit 80 serves to detect the level of the waste toner collected in the toner container 46 (described later).

The ROM 92 and the RAM 93 are connected to the CPU 91 (exemplary "determination unit, control unit, and measurement unit") which controls the respective components via the control unit 95 in accordance with the processing procedure stored in the ROM 92 while storing the processed results in the RAM 93. The network interface 94 is used for connecting an external device, for example, a personal computer (PC).

The main motor 96 serves to rotate the aforementioned conveyor belt 38 as described above. The scanner motor 97 serves to rotate the polygon mirror 22 within the scanner unit 20.

In response to the control of suppressing generation of the waste toner to be described later, the display unit 99 displays the information of such control.

The CPU 91 controls driving operations of the main motor 96 and the scanner motor 97 based on the program preliminarily stored in the ROM 92.

The control unit 95 controls the image forming unit 5 in accordance with the command from the CPU 91. Specifically, the control unit 95 executes the exposure control to allow the scanner unit 20 to expose the surface of the photoconductor drum 25 and the transfer bias control upon transfer of the toner to the recording medium 3.

The detection unit 100 is formed of various sensors including a detection sensor 100A (described later) electrically coupled with the control unit 95.

2. Calibration Structure

Figure 3:
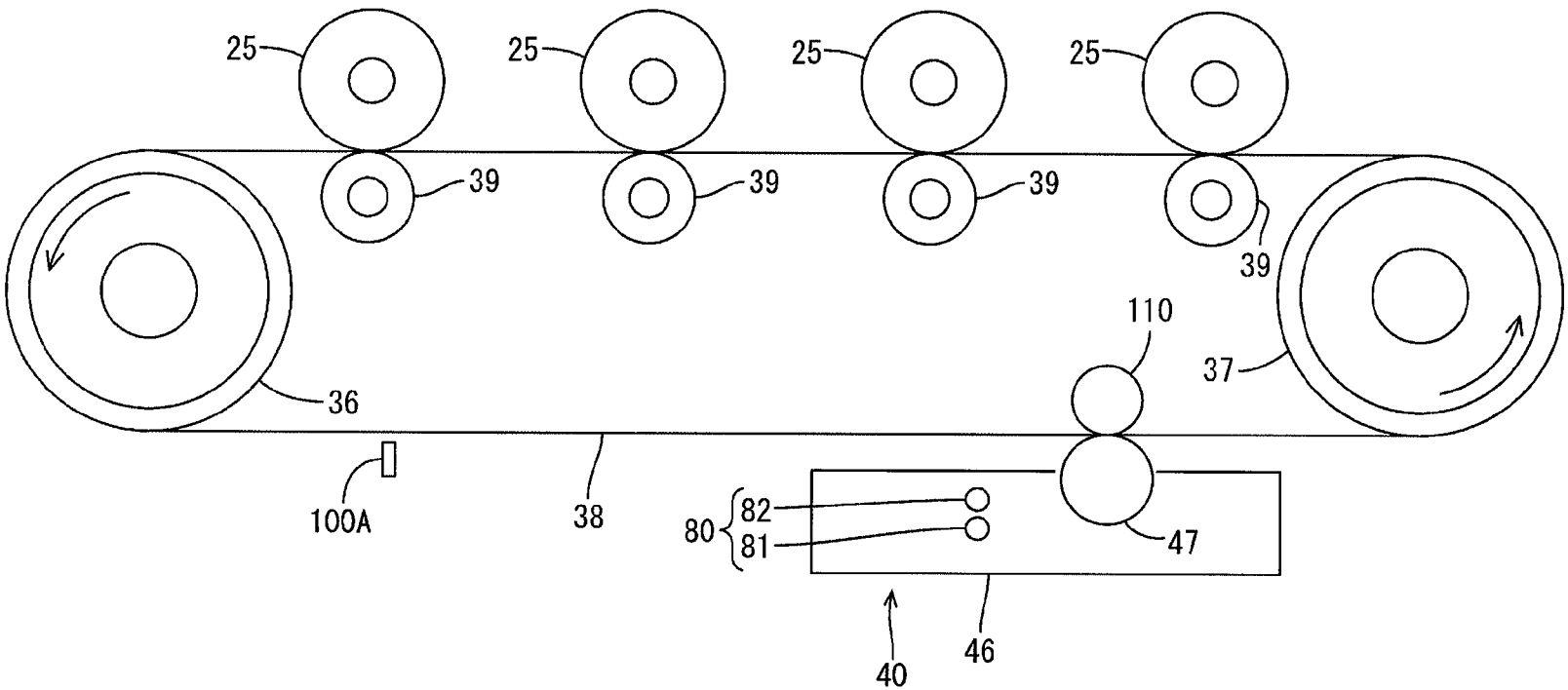
FIG. 3 is an explanatory view schematically showing the structure of the conveyor belt and other structures positioned proximate.

FIG. 3 is a view schematically showing the structure of the conveyor belt 38 and a portion therearound. The printer 1 is structured to perform calibration for adjusting each transfer position and density of images of the respective colors, for example. The conveyor belt 38 conveys the sheet, as described above. However, the conveyor belt 38 receives the direct transfer of the measurement pattern (for calibration) formed by the image forming unit 5 during the calibration process.

Referring to FIGS. 1 and 3, the laser printer 1 includes the toner detection sensor 100A for detecting the measurement pattern (toner) on the surface of the conveyor belt 38.

The detection sensor 100A includes a light emitting element for emitting light, and a light receiving element that receives, among the emitted light, light reflected from the toner (measurement pattern) on the conveyor belt 38.

When the transfer positions of the respective color images are adjusted, the detection sensor 100A measures intervals between the adjacent measurement patterns of the respective colors. If a deviation is found in the measured interval, the interval is adjusted to the normal interval (see FIG. 4).

During density adjustment, when the measurement pattern at the designated density is carried, the actual density of the measurement pattern is measured in accordance with the amount of light received, which is reflected from the measurement pattern. If there is the difference between the designated density and the measured density, image forming conditions (such as the development bias or the like) may be changed to adjust the density (see FIG. 5).

In addition, the tone adjustment using the density measurement pattern formed of a plurality of tones is performed.

For example, the pulse-surface-area modulation using a dither matrix (or the like) can be generally used to realize the tone for the purpose of displaying the half tone images (like a photograph). The density characteristics of the image to be actually formed (tone expressivity) is influenced by characteristics of the toner and the photoconductor drum to show different proportional characteristic of the density in accordance with the area ratio. In order to correct the different characteristics, a data conversion table that is referred to as a gamma correction table is used to adjust the density characteristic of the image to be actually formed. When the density measurement pattern formed of a plurality of tones is carried, each density of the respective tones may be measured in accordance with the amount of light received, the light being reflected from the measurement pattern at the respective tones. Based on each density of the plurality of measured tones, the density of the other tone among 256 tones, which has not been measured, is estimated. If the measured (estimated) density is different from the actual density, the data of the gamma correction table are corrected so that the deviation in the density (shading) of the images can be adjusted (see FIG. 6).

The measurement pattern which has been carried on the conveyor belt 38 to pass through the detection sensor 10A, and the toner that has not been used for the image forming operation and resides on the conveyor belt 38 is removed from the conveyor belt 38 by the belt cleaning unit 40 so as to be collected in the toner container 46 as waste toner.

3. Structure for Delaying the Timing at which the Waste Toner Reaches the Maximum Storage Level Referring to FIGS. 1 and 3, the toner container 46 of the belt cleaning unit 40 includes a toner detection unit 80. The toner detection unit 80 includes a toner full detection sensor 82 (exemplary "detection unit") for detecting that the waste toner reaches the maximum storage level of the toner container 46, and a near full detection sensor 81 for detecting that the waste toner reaches the predetermined storage level that is slightly lower than the maximum storage level.

Each of those detection sensors 81 and 82 includes a light emitting element and a light receiving element that can be provided on both side walls (the near and far sides of FIG. 3) to form an optical axis inside the toner container 46. The toner full detection sensor 82 forms the optical axis at the upper end portion of the toner container 46. When the optical axis is intercepted, the toner full detection sensor 82 detects that the stored waste toner reaches the maximum storage level of the toner container 46. The near full detection sensor 81 forms the optical axis at a portion slightly lower than the toner full detection sensor 82, and detects that the stored waste toner reaches the predetermined level near the maximum storage level of the toner container 46.

4. Process for Delaying the Timing at which the Waste Toner Reaches the Maximum Storage Level In the present aspect, the amount of the waste toner generated by calibration is reduced so as to delay the timing at which the waste toner reaches the maximum storage level.

In the present aspect, the calibration is not performed immediately after the need of the calibration is recognized but performed after the printing request is confirmed. More specifically, when the need for calibration is recognized, the flag is set. The flag is checked just before the start of the printing such that the calibration is performed conforming to a need for calibration.

The printing operation in response to the command to perform the printing onto the sheet will be described in detail.

<Printing Operation>

Figure 7:
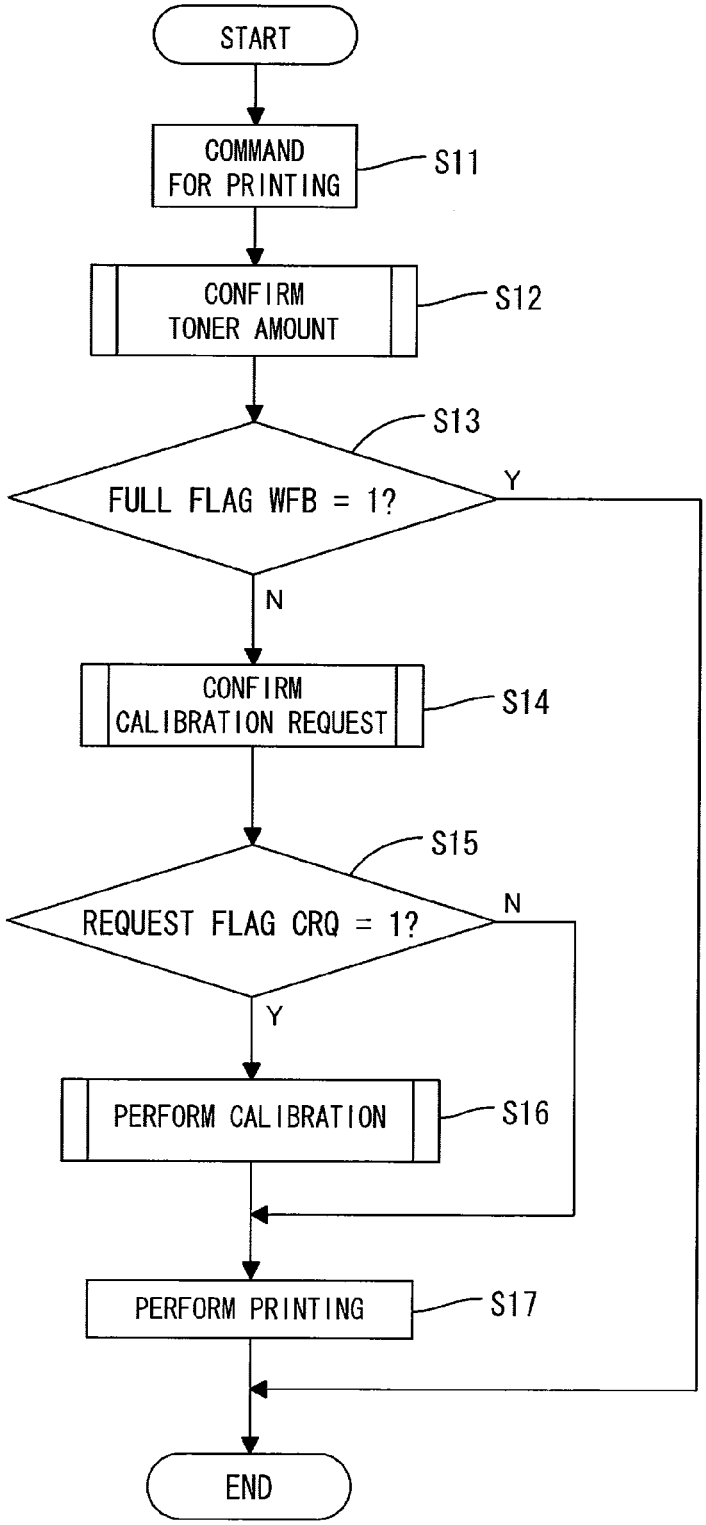
FIG. 7 is a flowchart of a routine for printing operations.

FIG. 7 is a flowchart of a routine for the printing operation.

Referring to FIG. 7, in response to the command for printing from the operation unit 98 or an external terminal (not shown) such as the PC in S11, the CPU 91 executes the toner level confirmation process to confirm the level of the toner stored in the toner container 46 in S12.

<Toner Level Confirmation Process>

Figure 8:
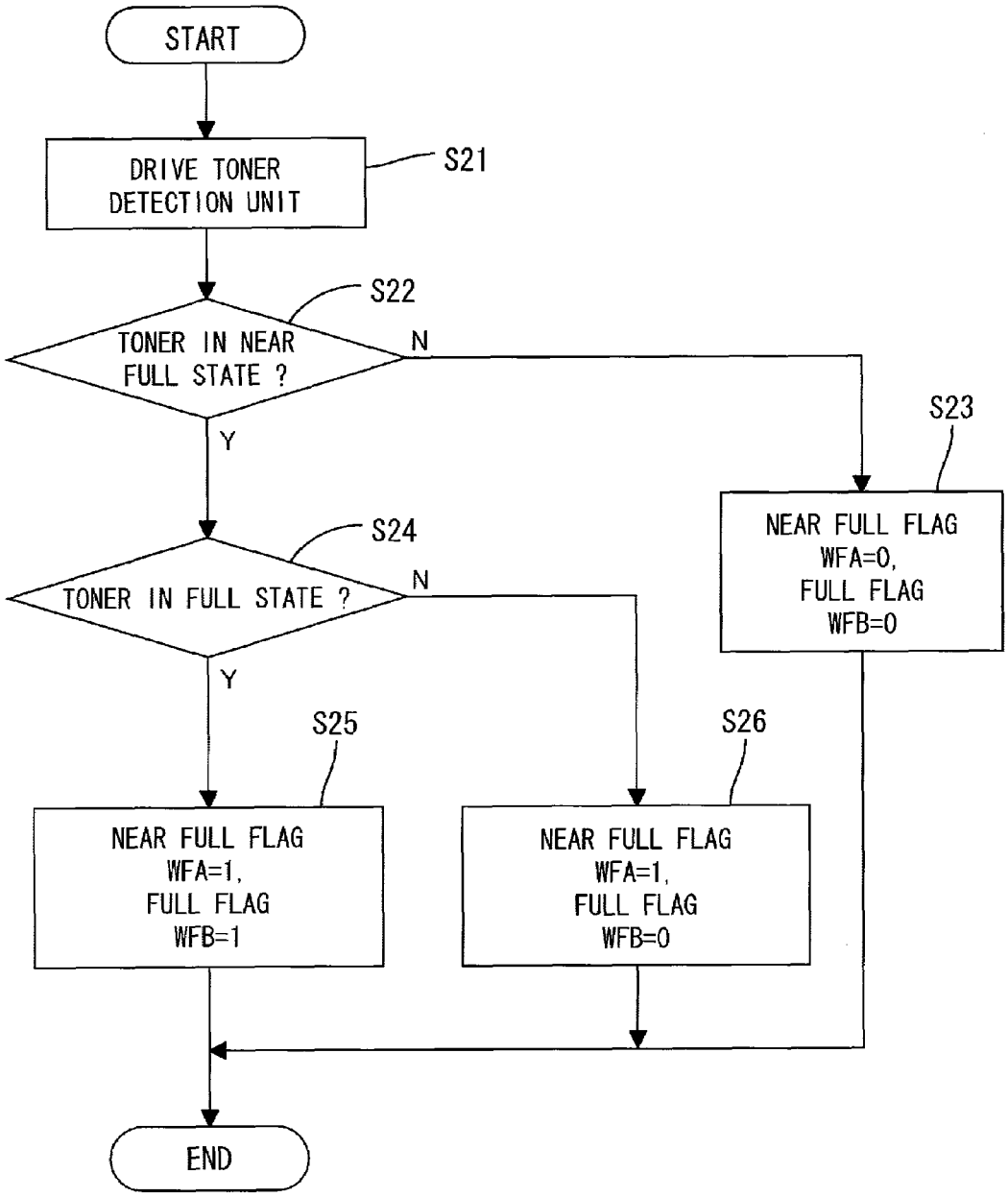
FIG. 8 is a flowchart of a routine for confirming the storage level of the waste toner.

FIG. 8 is a flowchart of a routine for the toner level confirmation process.

Referring to FIG. 8, during the toner level confirmation process, the CPU 91 drives the toner detection unit 80 in S21.

The CPU 91 determines whether the waste toner reaches the predetermined storage level (near full) that is slightly lower than the maximum storage level based on the signal from the toner detection unit 80 in S22.

If it is determined that the waste toner has not reached the predetermined storage level, that is, N is obtained in S22, neither a near full flag WFA nor a full flag WFB is set in S23 where the WFA and WFB are set to 0, respectively.

Meanwhile, if it is determined that the waste toner has reached the predetermined storage level, that is, Y is obtained in S22, the CPU 91 determines whether the waste toner has reached the maximum storage level (full) based on the signal from the toner detection unit 80 in S24.

If it is determined that the waste toner has reached the maximum storage level, that is, Y is obtained in S24, both the near full flag WFA and the full flag WFB are set in S25 where the WFA and WFB are set to 1, respectively.

Meanwhile, if it is determined that the waste toner has not reached the maximum storage level, that is, N is obtained in S24, the near full flag WFA is set, but the full flag WFB is not set in S26 where the WFA is set to 1 and the WFB is set to 0, respectively. Thereby, the toner level confirmation process ends.

In S13 of the flowchart shown in FIG. 7, the CPU 91 determines whether the full flag WFB is set, that is, the WFB is set to 1.

If it is determined that the full flag WFB is set, that is, Y is obtained in S13, the waste toner has already reached the maximum storage level. Accordingly, the CPU 91 stops the image forming operation performed by the image forming unit 5 to finish the printing so as to prevent the toner leakage caused by further printing operation.

Meanwhile, if it is determined that the full flag WFB is not set, a calibration request confirmation process is performed in S14.

<Calibration Request Confirmation Process>

Figure 9:
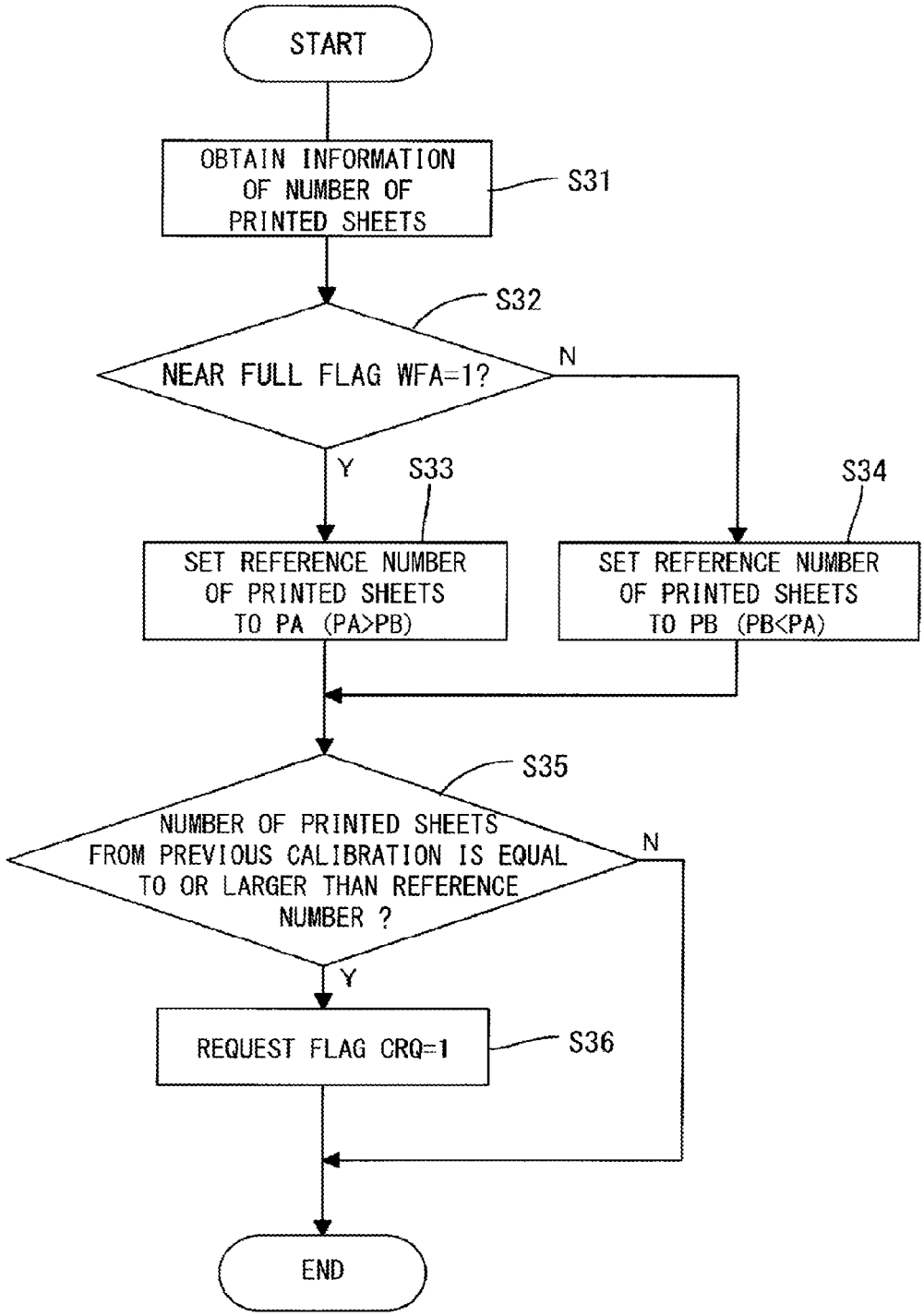
FIG. 9 is a flowchart of a routine for confirming the calibration request.

FIG. 9 is a flowchart of a routine for confirming the calibration request.

During the calibration request confirmation process as shown in FIG. 9, the CPU 91 obtains information of the number of printed sheets which contains a total number of the recording media 3 (number of printed sheets Pa1) which has been printed from the initial setting of the printer 1 to the present time, and a total number of the recording media 3 (number of printed sheets Pa0) which has been printed from the initial setting of the printer 1 to execution of the previous calibration (S31).

The CPU 91 then determines whether the near full flag WFA is set, that is, the WFA is set to 1 (S32).

If it is determined that the near full flag WFA is set, that is, Y is obtained in S32, the number of printed sheets before the calibration is set (updated) to a reference number of the printed sheets (exemplary "predetermined execution condition") that has a larger value PA (for example, 1000 sheets, PA>PB) in S33.

Meanwhile, if it is determined that the near full flag WFA is not set, that is, N is obtained in S32 where the WFA is set to 0, the number of printed sheets before the calibration is set (updated) to a reference number of the printed sheets that has a smaller value PB (for example, 500 sheets, PB<PA) in S34.

In S35, the CPU 91 determines whether the number of printed sheets from the previous calibration, that is, ΔPa (=Pa1−Pa0) is equal to or larger than the set reference number of the printed sheets.

If the number of the printed sheets ΔPa is equal to or larger than the reference number of the printed sheets, that is, Y is obtained in S35, a calibration request flag CRQ that indicates the request for calibration is set in S36 where the CRQ is set to 1. Meanwhile, if the number of the printed sheets ΔPa is not equal to or larger than the reference number, that is, N is obtained in S35, the calibration request flag CRQ is not set, that is, the CRQ is set to 0.

Then in S15 of the flowchart shown in FIG. 7, the CPU 91 determines whether the calibration request flag CRQ is set, that is, the CRQ is set to 1.

If the calibration request flag CRQ is not set, that is, N is obtained in S15 where the CRQ is set to 0, the printing is performed without executing the calibration in S17.

If the calibration request flag CRQ is set, that is, Y is obtained in S15 where the CRQ is set to 1, the calibration is executed in S16.

<Calibration Process>

Figure 10:
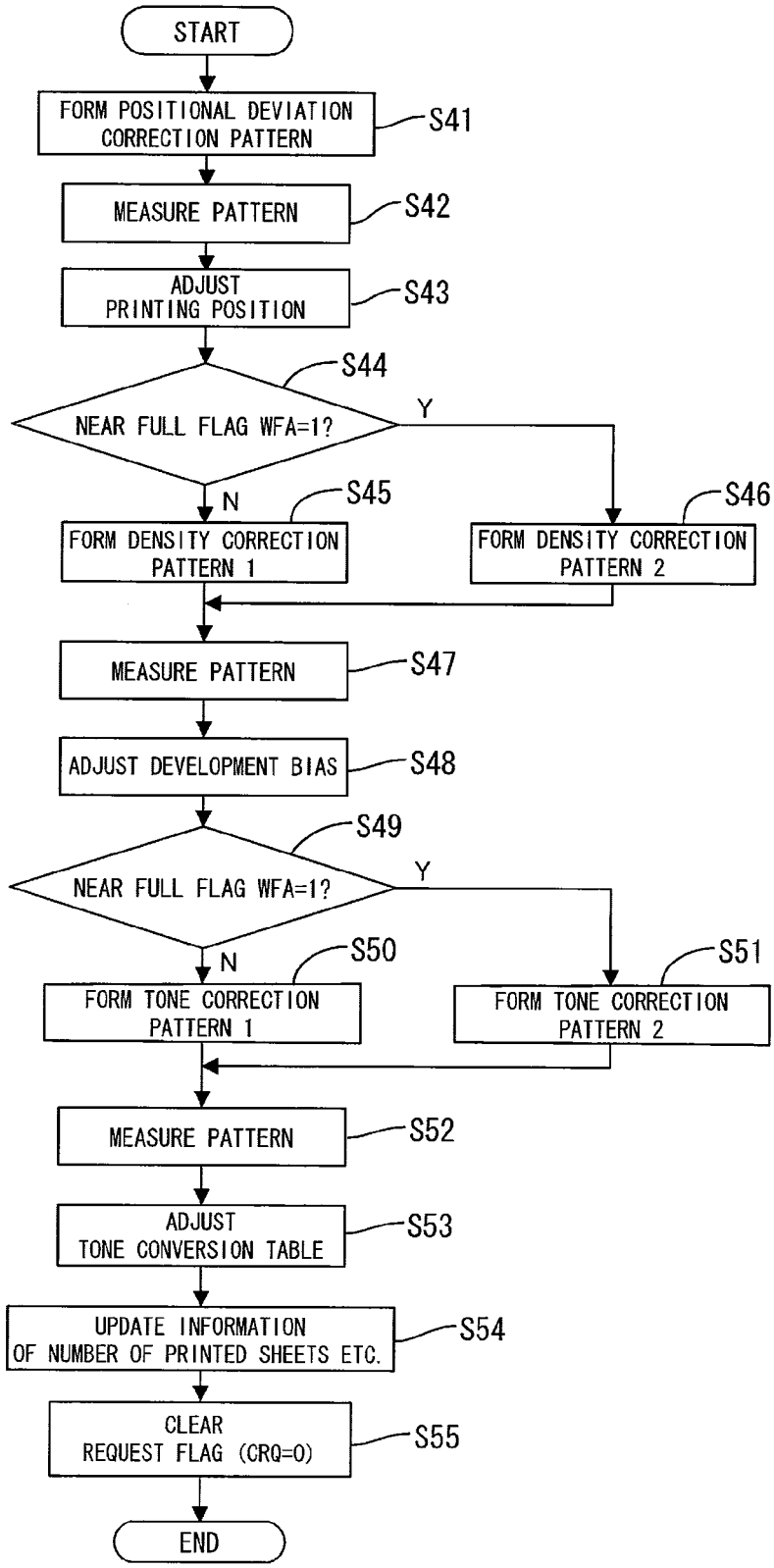
FIG. 10 is a flowchart of a routine for the calibration.

FIG. 10 is a flowchart of a routine for the calibration process.

During the calibration process shown in FIG. 10, the CPU 91 activates the image forming unit 5 to create the positional deviation correction patterns such that the toners corresponding to the respective colors Y, M, C, K in this order are formed on the conveyor belt 38 at predetermined intervals in S41. The light rays generated from the emitting/receiving operation of the detection sensor 100A and reflected from the positional deviation correction patterns are received by the detection sensor 10A. It is then determined whether the positional deviation correction patterns are formed at the predetermined intervals in accordance with the interval between the received light rays in S42.

The deviation between intervals of the positional deviation correction patterns may cause the deviation between the printing positions of the respective colors during printing on the sheet. The image forming timing is adjusted to correct the printing position to the normal position in S43.

In S44, the CPU 91 determines whether the near full flag WFA is set. If the near full flag WFA is not set, that is, N is obtained in S44 where the WFA is set to 0, a density correction pattern 1 having a predetermined length at a predetermined (single) density is formed on the conveyor belt 38 in S45.

The density correction pattern is used for measuring whether the image forming process such as the charge bias, the development bias, and/or the transfer bias has been appropriately performed. It is detected whether the measurement pattern at the predetermined density has been formed in accordance with the amount of light received, which is detected through the light emitting and receiving operation of the detection sensor 100A. If the deviation occurs in the measured density, the image forming process conditions such as the charge bias, the development bias and/or the transfer bias is adjusted depending on the deviation.

Figure 5:
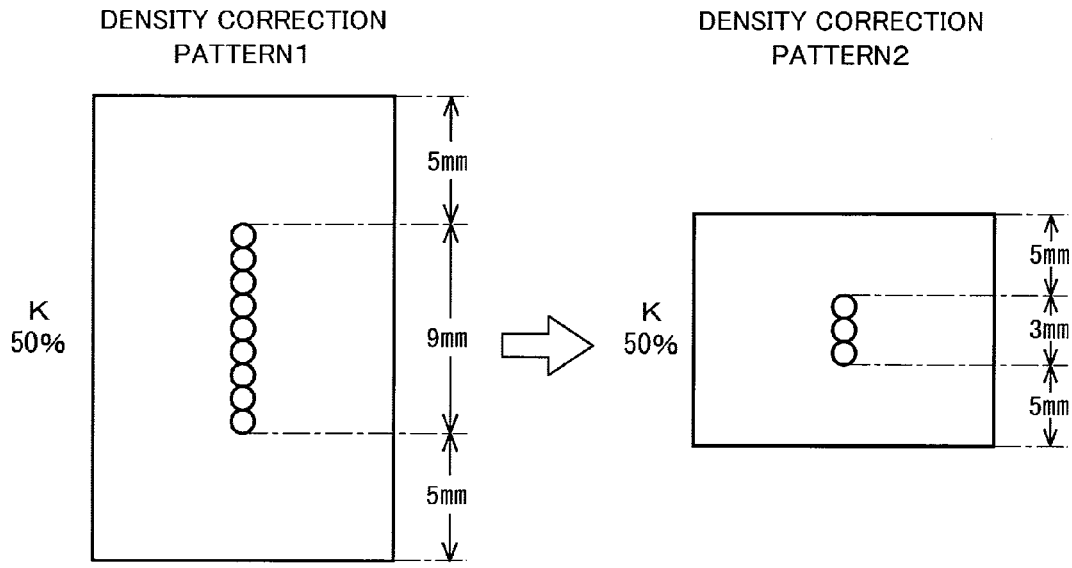
FIG. 5 is a view showing measurement patterns for measuring the density.

If the near full flag WFA is set, that is, Y is obtained in S44 where the WFA is set to 1, a density correction pattern 2 having a length shorter than that of the density correction pattern 1 at the predetermined (single) density is formed on the conveyor belt 38 in S46. If the waste toner has reached the near full level, the amount of the toner collected as the waste toner in the toner container 46 is reduced after the density measurement. Accordingly, the timing at which the toner stored in the toner container 46 reaches the maximum storage level can be delayed. Referring to FIG. 5, the light emitting/receiving operation with respect to a single measurement pattern is performed plural times by the detection sensor 100A. The number of times for detection performed by the detection sensor 100A is reduced by the amount corresponding to the reduction of the measurement pattern (for example, in the drawing, the light emitting/receiving operation with respect to the density correction pattern 1 is operated 9 times, and the light receiving operation with respect to the density correction pattern 2 is operated 3 times. The predetermined interval between successive measurement portions is not detected for the removal of noise caused by disturbance light).

In the case where the waste toner reaches the near full level, and the density is corrected with the density correction pattern 2, the amount of the toner used for the correction is reduced compared with the case in which the density correction pattern 1 is used. This may provide the advantage to delay the timing at which the toner in the toner container 46 reaches the maximum storage level. However, this may cause the disadvantage to deteriorate the accuracy in the density correction owing to the reduced number of measurement points.

In S47, the CPU 91 allows the detection sensor 100A to emit and receive the light by the number of times corresponding to the length of the density correction pattern, and to measure the density of the density correction pattern in accordance with the reception amount of the reflected light. If the deviation in the density occurs between the measured density correction patterns, the image forming process condition (such as the development bias) is adjusted in S48 in accordance with the deviation in the density.

Further, it is determined whether the near full flag WFA has been set in S49.

Figure 6:
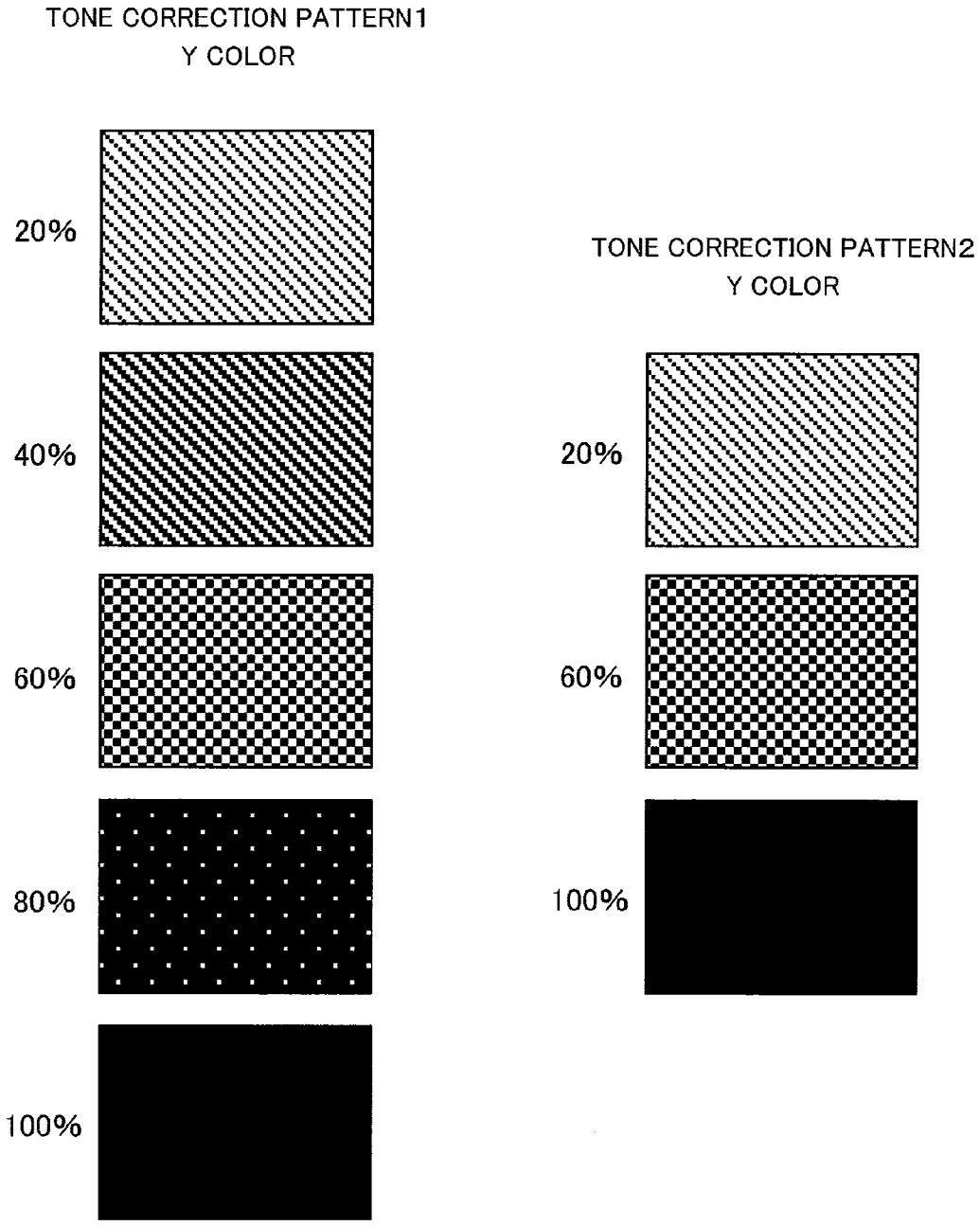
FIG. 6 is a view showing the measurement pattern formed of different tones.

If the near full flag WFA is not set, that is, N is obtained in S49 where the WFA is set to 0, a tone correction pattern 1 as shown in FIG. 6 is formed on the conveyor belt 38 in S50. The tone correction pattern 1 can include five tone patterns corresponding to tone levels of 20%, 40%, 60%, 80% and 100% for the respective colors (FIG. 6 only shows the pattern for the color Y).

If the near full flag WFA is set, that is, Y is obtained in S49 where the WFA is set to 1, the tone correction pattern 2 (with the number of tones smaller than that of the tone correction pattern 1) is formed on the conveyor belt 38 in S51. The tone correction pattern 2 can include three tone patterns corresponding to tone levels of 20%, 60% and 100% for the respective colors.

In the case where the waste toner reaches the near full level, and the tone correction is performed using the tone correction pattern 2, the amount of toner consumed is smaller compared with the case in which the tone correction pattern 1 is used. This can provide the advantage to delay the timing at which the toner in the toner container 46 reaches the maximum storage level. However, this may provide the disadvantage to reduce the number of the tone patterns to be measured, and thus deteriorate the accuracy in the tone correction.

The CPU 91 measures the respective tones and densities in S52, and estimates the density of the tone other than the densities of the measured tones, in reference to the graph (or table) representing the relationship between the measured tone and the corresponding density. The information contained in the tone conversion table (density conversion table) is changed (updated) in accordance with the difference between the original density of each tone and the measured (estimated) density thereof. In the case where the density of the tone has been gradually lowered over time, for example, the tone conversion table is corrected to make the density higher in S53.

In S54, the CPU 91 rewrites (updates) the information with respect to the number of printed sheets stored in the RAM 93 (or the like) with the information with respect to the latest number of printed sheets (or the like). In S55, the CPU 91 clears the calibration request flag CRQ (CRQ is set to 0), and ends the calibration process.

After the image is appropriately corrected through the calibration, the process proceeds to S17 of the flowchart shown in FIG. 7 where the image forming unit 5 performs printing on the sheet carried on the conveyor belt 38.

5. Effect of the Embodiment (1) In the present aspect, the control of suppressing generation of the waste toner is executed when the CPU 91 (serving as the determination unit and the control unit) determines that the waste toner reaches the predetermined storage level that is lower than the maximum storage level. This makes it possible to delay the time at which the waste toner collected in the toner container 46 reaches the maximum storage level without increasing the strain imposed on the user.

(2) In the present aspect, when the CPU 91 determines that the waste toner reaches the predetermined storage level, the number of the sheets printed before the calibration (exemplary "number of recording media on which the image has been formed") is changed to a larger value so as to execute control of suppressing the generation of waste toner caused by forming the measurement pattern. Accordingly, the timing at which the toner collected in the toner container 46 reaches the maximum storage level can be delayed with the simple structure for changing the number of the printed sheets to the larger value.

(3) In the present aspect, when the CPU 91 determines that the waste toner reaches the predetermined storage level, the area of the density pattern is changed to be small so as to execute the control of suppressing generation of the waste toner. Accordingly, the timing at which the waste toner in the toner container 46 reaches the maximum storage level can be delayed as the amount of the toner stored in the toner container 46 is made smaller by reducing the area of the density pattern.

(4) In the present aspect, when the CPU 91 determines that the waste toner reaches the predetermined storage level, the number of the plurality of tones which constitute the density pattern is reduced. Accordingly, the amount of toner in the toner container 46 can be reduced by decreasing the number of the tones of the density pattern. As a result, the timing at which the waste toner stored in the toner container 46 can be delayed.

(5) The CPU 91 (control unit) stops the image forming operation when the toner detection unit 80 (detection unit) detects that the waste toner reaches the maximum storage level. This makes it possible to prevent the toner leakage or the like owing to collection of the waste toner at the level equal to or higher than the maximum storage level of the toner container 46.

<Another Aspect>

Another aspect of the present invention will be described referring to FIG. 11.

In the aspect described above, the calibration request is confirmed based on the number of printed sheets by performing the process for confirming the calibration request. In the present aspect, the calibration request is confirmed based on the elapsed time by performing the process for confirming the calibration request. The same components as those of the foregoing aspect will be designated with the same reference numerals and explanations thereof, thus will be omitted.

<Calibration Request Confirmation Process>

Figure 11:
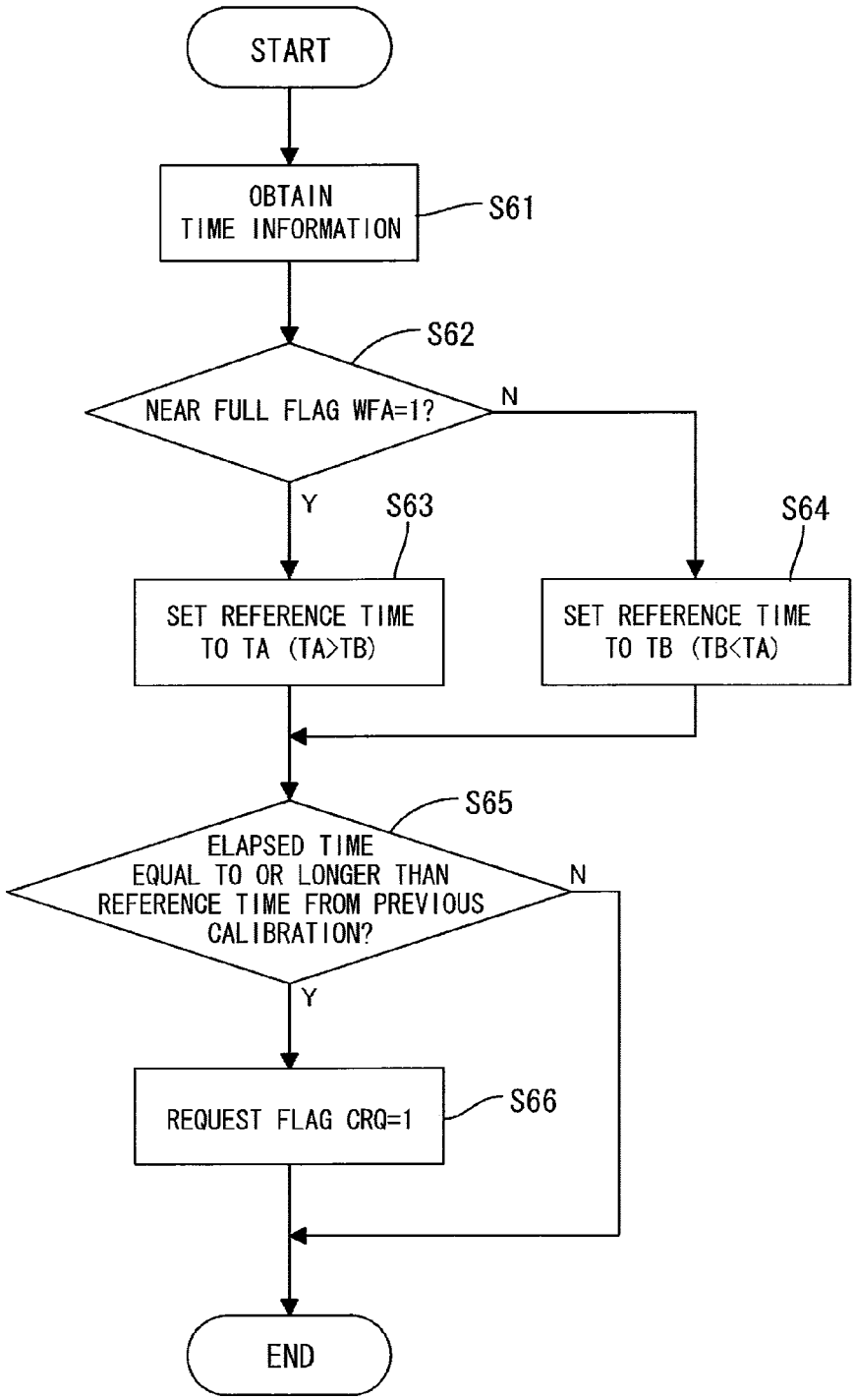
FIG. 11 is a flowchart of a routine for confirming the calibration request according to another aspect of the present invention.

FIG. 11 is a flowchart of a routine for confirming the calibration request according to the present aspect.

In S61, the CPU 91 obtains the time information which contains the time T0 at which the previous calibration is performed and the current time T1, as shown in FIG. 11.

In S62, it is determined whether the near full flag WFA is set, that is, the WFA is set to 1.

If the near full flag WFA is not set, that is, N is obtained in S62 where the WFA is set to 0, the process proceeds to S64 where a time interval between successive calibrating operations is updated (set) to the normal reference time TB (<TA).

Meanwhile if the near full flag WFA has been set, that is, Y is obtained in S62 where the WFA is set to 1, the process proceeds to S63 where the time interval between successive calibrating operations is updated (set) to the reference time TA which is longer than the reference time TB.

In S65, it is determined whether the elapsed time from execution of the previous calibration to the current time {ΔT (=T1−T0)}, is equal to or longer than the reference time set in S63 or S64.

If the elapsed time ΔT is equal to or longer than the reference time, that is, Y is obtained in S65, the calibration request flag CRQ is set in S66 where the CRQ is set to 1. If the elapsed time ΔT is not equal to or longer than the reference time, that is, N is obtained in S65, the calibration request flag CRQ is not set, that is the CRQ is set to 0.

In the present aspect, when the CPU 91 (determination unit) determines that the waste toner reaches the predetermined storage level, the time elapsed between successive calibrating operations (exemplary "time interval of execution of the pattern forming unit") is changed to the larger value so as to execute control of suppressing generation of the waste toner resulting from formation of the measurement pattern. Accordingly, the timing at which the waste toner collected in the toner container 46 reaches the maximum storage level can be extended with the simple structure to change the aforementioned elapsed time to the larger value.

<Another Aspect>

Another aspect of the present invention will be described referring to FIG. 12.

Changes in the environmental conditions, such as temperature change, humidity change and the like may adversely influence the image quality. In the case where the environmental condition is changed by the amount equal to or greater than a reference value, the calibration may be performed. Meanwhile, in the present aspect, the reference values of the environmental conditions are increased when the waste toner reaches the predetermined level so as to decrease the number of executions of calibration and to suppress generation of the waste toner. Accordingly, a temperature sensor (not shown) that measures the ambient temperature and a humidity sensor (not shown) that measures the humidity may be provided as the detection unit 100.

<Calibration Request Confirmation Process>

Figure 12:
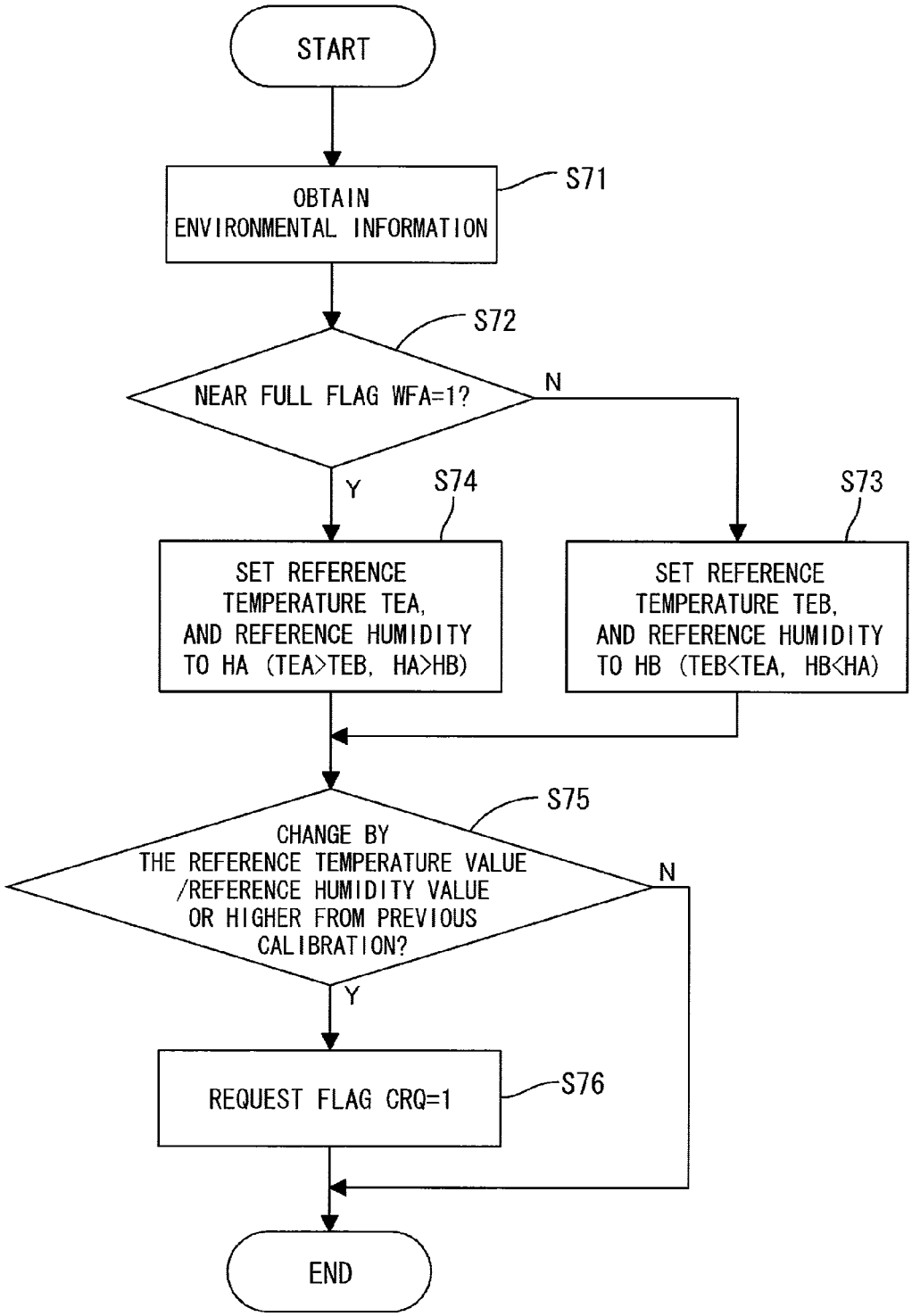
FIG. 12 is a flowchart of a routine for confirming the calibration request according to another aspect of the present invention.

Referring to FIG. 12, the CPU 91 obtains environmental information which contains a temperature TE0 measured in the previous calibration, a current temperature TE1, a humidity H0 measured in the previous calibration, and a current humidity H1 in S71.

In S72, it is determined whether the near full flag WFA is set, that is, the WFA is set to 1.

If the near full flag WFA is not set, that is, N is obtained in S72 where the WFA is set to 0, the reference values for the environmental conditions are set (updated) to a reference temperature TEB and a reference humidity HB, respectively in S73.

Meanwhile, if the near full flag WFA is set, that is, Y is obtained in S72 where the WFA is set to 1, the waste toner is about to reach the maximum storage level. Then the process proceeds to S74 where the reference values for the environmental conditions are set to a reference temperature TEA and a reference humidity HA both of which are larger than the reference temperature TEB and the reference humidity HB, respectively. In the case where the waste toner becomes equal to or higher than the predetermined storage level, the number of execution of the calibration may be reduced.

Then in S75, it is determined whether a temperature change ΔTE (=TE1−TE0) from the previous calibration, or a humidity change ΔH (=H1−H0) from the previous calibration is equal to or larger than the reference value (reference temperature, reference humidity), respectively.

If the aforementioned change is equal to or larger than the reference value, that is, Y is obtained in S75, the calibration request flag CRQ is set in S76 where the CRQ is set to 1. If the change is not equal to or larger than the reference value, that is, N is obtained in S75, the request flag CRQ is not set, that is CRQ is set to 0.

Thereafter, the information of the environmental conditions such as the stored temperature and humidity is updated.

In the present aspect, the changes in the temperature and the humidity as the environmental conditions are measured, and in the case where any one of the conditions changes by the amount equal to or larger than the reference value, the calibration is performed. However, the change in only one of the temperature and the humidity may be measured as the environmental condition. Then the calibration is performed in the case where the measured value is changed by an amount equal to or larger than the reference value.

<Another Aspect>

In the present aspect, the operation unit 98 (exemplary "setting unit", "switching unit") is used to selectively control whether or not to suppress generation of the waste toner. Note that the operation unit (not shown) of the PC connected to the printer 1 via a communication device may be employed for the selective control in the present aspect instead of the operation unit 98 of the printer 1.

Specifically, the operation unit 98 is operated to set the mode where generation of the waste toner is suppressed so as to allow the CPU 91 to execute the control of suppressing generation of the waste toner when it is determined that the waste toner reaches the predetermined storage level. If the operation unit 98 is operated to set the mode where generation of the waste toner is not suppressed, the control of suppressing generation of the waste toner is not executed even if it is determined that the waste toner reaches the predetermined storage level.

In addition, the user can perform detailed settings through the operation unit 98. In the detailed settings, the measurement pattern used at the mode where the calibration is performed can be selected from a plurality of measurement patterns including the patterns for the positional deviation correction, density correction and tone correction, and conversely, the measurement pattern used at the mode where the calibration is not performed can be selected.

If the mode where the calibration is performed is set through the operation unit 98, a flag corresponding to the correction is set, that is, a positional deviation correction flag FR is set to 1, a density correction flag FD is set to 1, and a tone correction flag FG is set to 1.

<Calibration Process>

Figure 13:
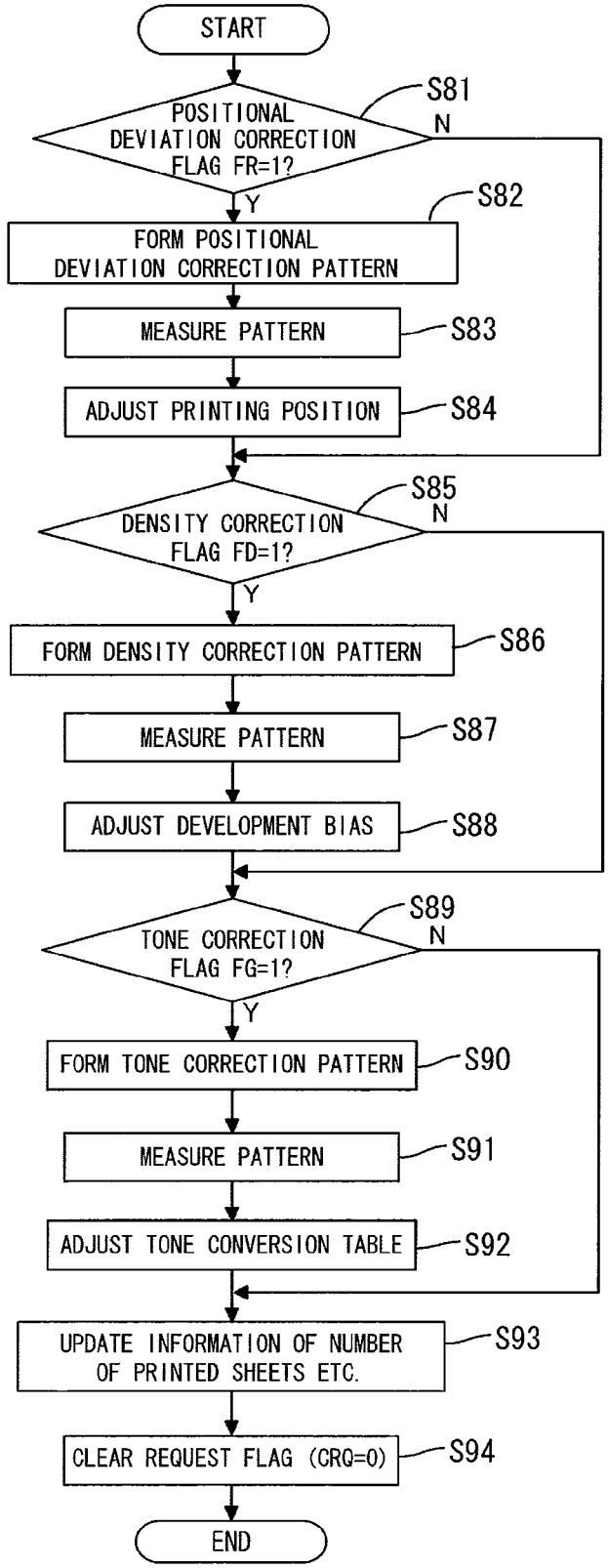
FIG. 13 is a flowchart of a routine for the calibration according to another aspect of the present invention.

In S81 of the flowchart shown in FIG. 13, it is determined whether the positional deviation correction flag FR is set.

If the positional deviation correction flag FR is not set, that is, N is obtained in S81, the process proceeds to S85 where it is determined whether the density correction flag FD is set.

Figure 4:
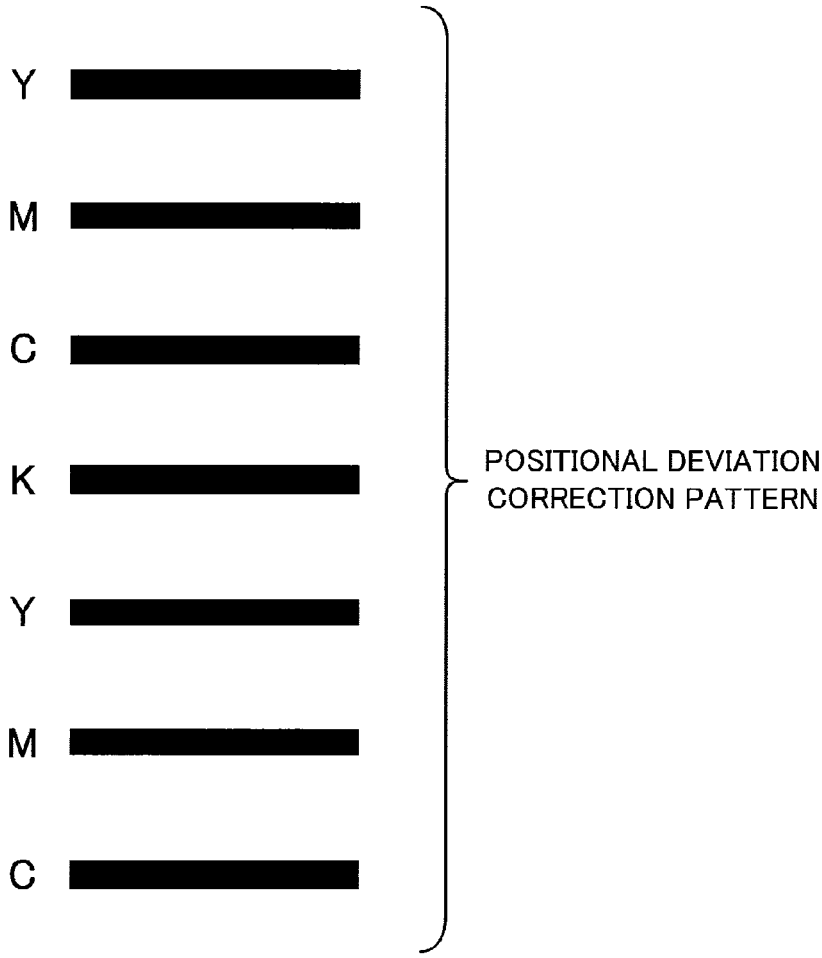
FIG. 4 is a view showing measurement patterns for measuring the positional deviation.

If the positional deviation correction flag FR is set, that is, Y is obtained in S81 where the FR is set to 1, positional deviation correction patterns are formed to be arranged at predetermined intervals in the order of the colors Y, M, C, and K in S82 (see FIG. 4). The light rays generated from the emitting/receiving operation of the detection sensor 100A and reflected from the positional deviation correction patterns are received by the detection sensor 100A. It is then determined whether the positional deviation correction patterns are formed at the predetermined intervals in accordance with the interval between the received light rays in S83.

In the case where the deviation occurs in the interval between the positional deviation correction patterns, the deviation may occur in the printing positions of the respective colors. Then in S84, the printing position is adjusted to the normal position by adjusting the image forming timing.

In S85, it is determined whether the density correction flag FD is set.

If the density correction flag FD is not set, that is, N is obtained in S85, the process proceeds to S89 where it is determined whether the tone correction flag FG is set.

If the density correction flag FD is set, that is, Y is obtained in S85 where the FD is set to 1, the process proceeds to S86 where the density correction pattern 1 with the predetermined length is formed on the conveyor belt 38 (see FIG. 5).

The detection sensor 100A measures the density corresponding to the density correction pattern the number of times corresponding to the length of the density correction pattern in S87. In the case where the deviation occurs in the density of the measured density correction pattern, the development bias can be adjusted in accordance with the deviation in density in S88.

In S89, it is determined whether the tone correction flag FG is set.

If the tone correction flag FG is not set, that is, N is obtained in S89 where FG is set to 0, the process proceeds to S93 where the information that contains the number of the printed sheets and the like is updated.

If the tone correction flag FG is set, that is, Y is obtained in S89 where FG is set to 1, the tone correction pattern 1 is formed on the conveyor belt 38 in S90 (see FIG. 6).

In S91, the CPU 91 measures the respective tones and densities, and estimates the density of the tone except those measured from the graph (or table) representing the relationship between the measured tones and densities. Based on the difference between the original density and the measured (estimated) density at each tone, the information contained in the tone conversion table (density conversion table) is changed (updated). In the case where the density of the tone has been gradually lighted over time, the tone conversion table is corrected to make the density higher in S92.

In S93, the information including the stored number of the printed sheets, and the environmental conditions such as the temperature and humidity is re-written (updated) with the obtained values of the number of printed sheets, temperature, and humidity. Then in S94, the calibration request flag CRQ is cleared, that is, the CRQ is set to 0 to end the calibration process.

According to the present aspect, the operation unit 98 (setting unit) is used such that the measurement pattern with higher importance is set, and the measurement pattern with lower importance is not set. Accordingly, it is possible for the user to decide whether to allow the disadvantage resultant from not executing one or more calibration processes in order to suppress generation of the waste toner. It is also possible for the user to select the calibration process to be executed, which makes it possible to suppress generation of the waste toner resulting from the measurement pattern with the lower importance.

<Another Aspect>

In another aspect, the user is allowed to command formation of the measurement pattern (command to perform the calibration) by operating the operation unit 98. The command for forming the measurement pattern is output to the CPU 91 from the operation unit 98 such that the calibration is performed.

Figure 15:
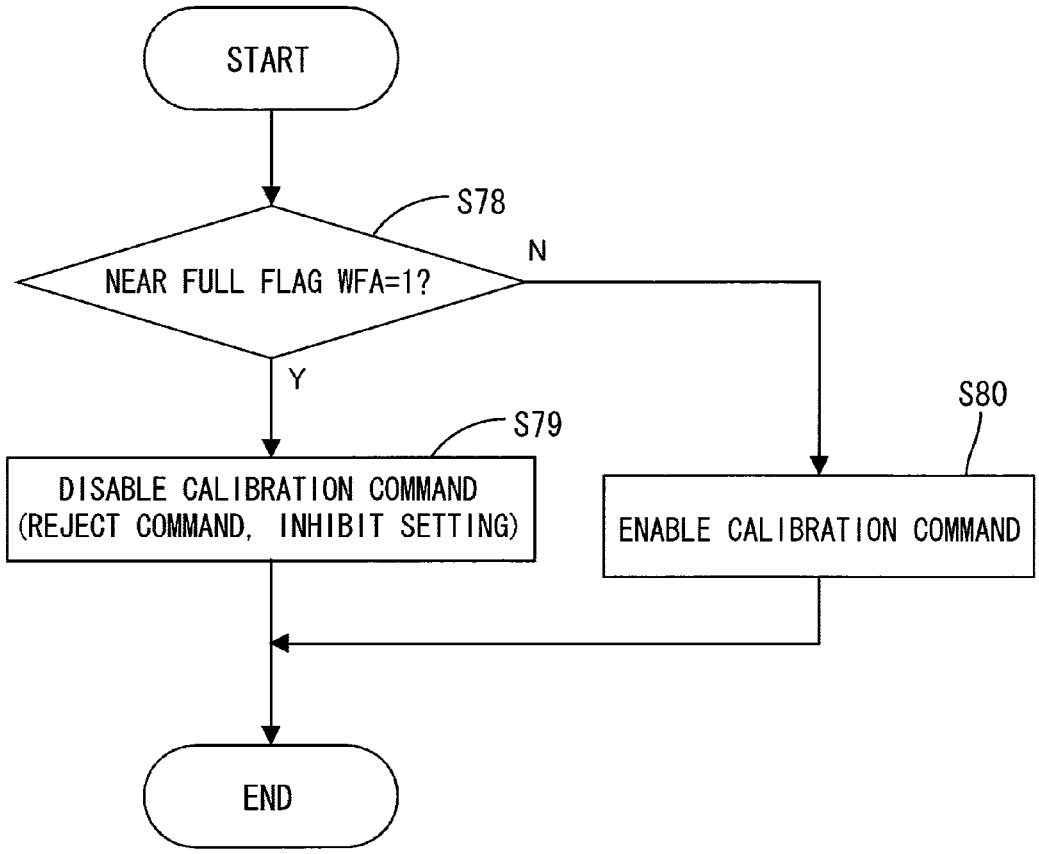
FIG. 15 is a flowchart of a routine for setting whether to accept the command output from the operation unit 98 or the like according to another aspect of the present invention.

FIG. 15 is a flowchart of a routine for setting whether to accept the command output from the operation unit 98 or the like according to the present aspect.

In the present aspect, when it is determined that the waste toner reaches the predetermined storage level, that is, Y is obtained in S78 where the WFA is set to 1, the CPU 91 is structured to reject the command even if the command for forming the measurement pattern is output from the operation unit 98 (or PC) in S79. When it is determined that the waste toner has not reached the predetermined storage level, that is, N is obtained in S78 where the WFA is set to 0, the command for forming the measurement pattern through the operation unit 98 is enabled (accepted) in S80. In this case, in response to the command for forming the measurement pattern, the corresponding measurement pattern is formed.

When it is determined that the waste toner reaches the predetermined storage level, that is, Y is obtained in S78 where the WFA is set to 1, the operation unit 98 may be structured to be disabled such that the aforementioned setting is not performed (inhibit the setting) in S79. The display of the calibration having the setting inhibited among a plurality of calibrations may be grayed out on the LCD so as not to be selected (see FIG. 14).

Among a plurality of calibration processes, the title of the calibration having the setting inhibited is displayed on the LCD of the operation unit 98. In the case where the control of suppressing generation of the waste toner is executed, the information relevant to the aforementioned control may be displayed on the display unit 99.

<Another Aspect>

Figure 14:
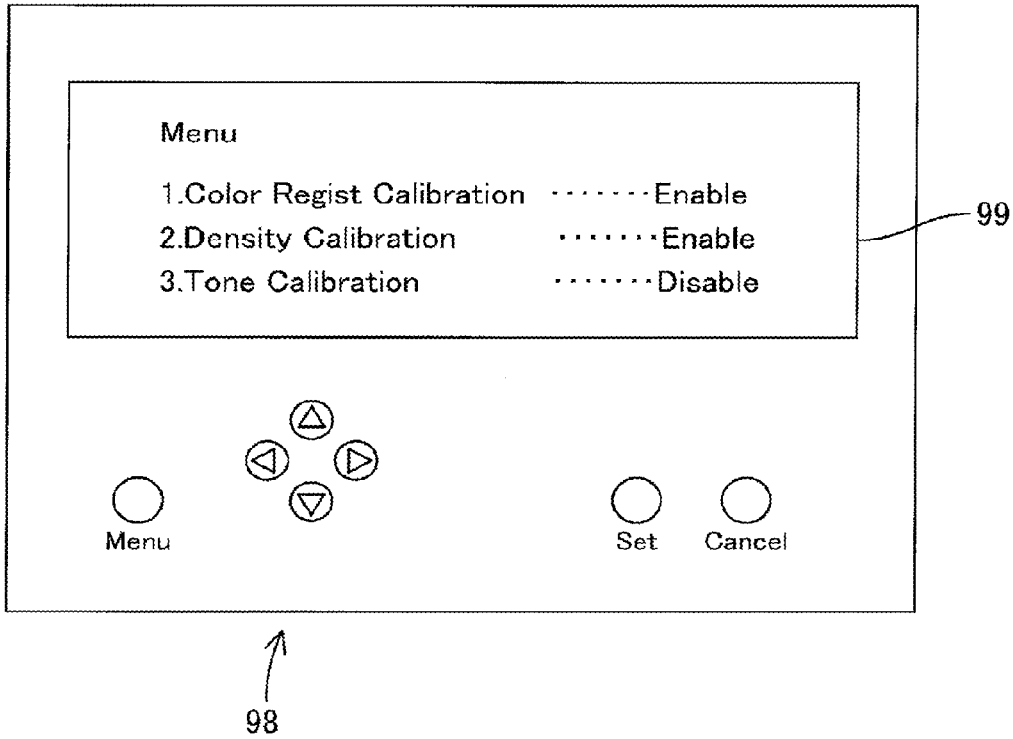
FIG. 14 is a view of a menu displayed on the display unit in a state where the calibration is set.

In the aspect shown in FIGS. 13 and 14, when it is determined that the waste toner reaches the predetermined storage level, the calibration process preliminarily selected from a plurality of the calibration processes by the user is executed. In the present aspect, however, when it is determined that the waste toner reaches the predetermined storage level, among a plurality of the calibration processes, the calibration using the tone correction pattern is not executed, but the calibration using the other measurement patterns (positional deviation correction and density correction) are executed regardless of the user's selection.

<Calibration Request Confirmation Process>

Figure 16:
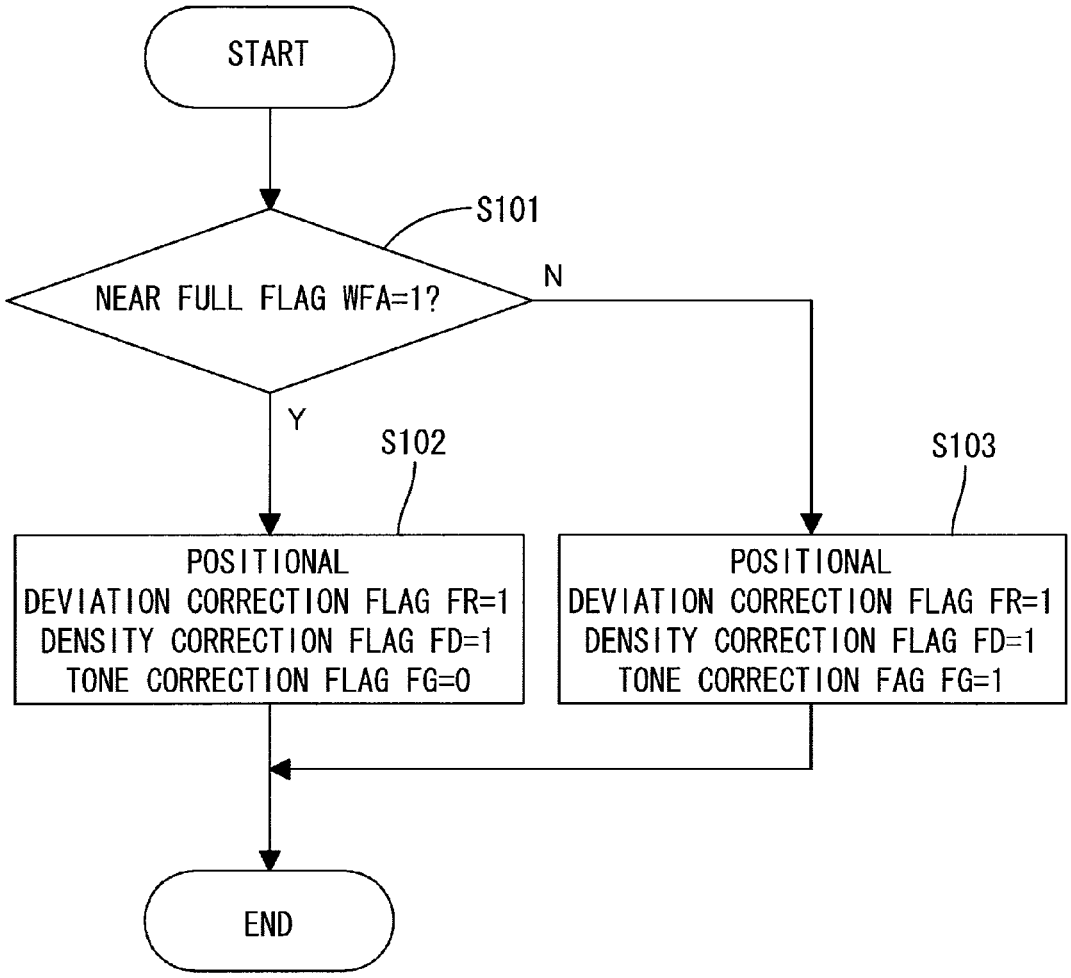
FIG. 16 is a flowchart for confirming the calibration request according to another aspect of the present invention.

FIG. 16 is a flowchart of a routine for confirming the calibration request according to the present aspect.

Referring to FIG. 16, it is determined whether the near full flag WFA is set, that is, the WFA is set to 1 in S101.

If the near full flag WFA is set, that is, Y is obtained in S101 where the WFA is set to 1, in S102 the positional deviation correction flag FR is set to 1, the density correction flag FD is set to 1, and the tone correction flag FG is set to 0, respectively. This makes it possible to inhibit execution of the calibration using the tone correction pattern.

If the near full flag WFA is not set, that is, N is obtained in S101 where the WFA is set to 0, in S103 the positional deviation correction flag FR is set to 1, the density correction flag FD is set to 1, and the tone correction flag FG is set to 1, respectively. Thus, all the calibration processes may be executed.

The deviation in the tone characteristics to a slight degree is unlikely to cause the extreme deterioration in the image quality so long as the image forming process conditions (for example, the charge bias, the development bias, the transfer bias, and the like) are appropriately set. Under the condition where the image forming process conditions are not appropriately set, the expressible range of the tone (dark and light) may be deviated. In this case, the tone characteristics cannot be corrected, which may cause the extreme deterioration in the image quality. Accordingly, the image forming process conditions need to be adjusted before correcting the tone characteristics.

In the present aspect, when the waste toner reaches the predetermined storage level, the tone correction pattern formed of a plurality of tones (density pattern) is not formed. This makes it possible to delay the timing at which the waste toner reaches the maximum storage level without further deteriorating the image quality.

<Further Aspects>

The present invention is not limited to the aforementioned aspects which have been described referring to the drawings. The following aspects may be included in the scope of the present invention.

(1) In the foregoing aspects, the height of the waste toner accumulated in the toner container 46 is optically detected by the toner detection unit 80, based on which the determination is made whether the waste toner reaches the predetermined storage level. However, the structure for making such determination is not limited to that as described above. For example, the weight of the waste toner may be measured such that the determination is made that the waste toner reaches the predetermined storage level when the measured weight reaches the predetermined weight value. Alternatively, the amount of the waste toner may be estimated based on the operation amount (number of the printed sheets) of the laser printer or the number of times for executing calibrations. Based on the estimated value, the determination is made whether the waste toner reaches the predetermined storage level.

(2) When the waste toner reaches the predetermined storage level, the control of suppressing generation of the waste toner may be executed using an arbitrary combination of the aforementioned structures (changing the number of printed sheets or the elapsed time, reducing the number of tones and the like).

(3) In the foregoing aspects, the calibration is performed during printing. However, it is not limited to this. The calibration may be performed upon any other processing, or in response to the command from the user. Alternatively, the calibration may be performed when the CPU 91 determines that the calibration is necessary. Further, the calibration may be performed at a predetermined time interval even in the absence of the command for printing. When the waste toner reaches the predetermined storage level, the predetermined time interval may be prolonged so as to suppress generation of the waste toner.

What is claimed is:

1. An image forming apparatus comprising:

an image carrier;

a cleaning unit configured to collect waste toner on said image carrier;

a toner container configured to store said waste toner collected by said cleaning unit;

a determination unit that determines whether said waste toner stored in said toner container reaches a predetermined storage level that is lower than a maximum storage level of said toner container; and a control unit configured to suppress generation of said waste toner when said determination unit determines that said waste toner has reached said predetermined storage level.

2. The image forming apparatus according to claim 1, further comprising a pattern forming unit that forms a measurement pattern on said image carrier when a predetermined execution condition is satisfied.

3. The image forming apparatus according to claim 2, wherein said cleaning unit is configured to collect a toner for said measurement pattern on said image carrier as said waste toner.

4. The image forming apparatus according to claim 3, wherein said control unit is configured to reduce said waste toner by changing said predetermined execution condition when said determination unit determines that said waste toner has reached said predetermined storage level.

5. The image forming apparatus according to claim 4, wherein said predetermined execution condition relates to at least one of a plurality of recording media on which an image is formed, and a time interval between execution cycles of said pattern forming unit.

6. The image forming apparatus according to claim 5, wherein said control unit changes said at least one of said number of recording media and said time interval between execution cycles to a larger value when said determination unit determines that said waste toner has reached said predetermined storage level.

7. The image forming apparatus according to claim 4, wherein when said determination unit determines that said waste toner has reached said predetermined storage level, said control unit changes said measurement pattern formed by said pattern forming unit to another measurement pattern that includes a smaller amount of toner.

8. The image forming apparatus according to claim 4, wherein said control unit rejects at least a part of a command to form a plurality of said measurement patterns when said determining unit determines that said waste toner has reached said predetermined storage level.

9. The image forming apparatus according to claim 4, wherein said control unit inhibits an operation to form said measurement pattern when said determination unit determines that said waste toner has reached said predetermined storage level.

10. The image forming apparatus according to claim 4, wherein said measurement pattern is a density pattern for measuring a density of the image.

11. The image forming apparatus according to claim 10, wherein said control unit changes said density pattern to a density pattern with a smaller area when said determination unit determines that said waste toner has reached said predetermined storage level.

12. The image forming apparatus according to claim 4, wherein said measurement pattern is a density pattern for measuring a density of an image formed of a plurality of different tones.

13. The image forming apparatus according to claim 12, wherein said control unit decrease a number of the tones of said density pattern when said determination unit determines that said waste toner has reached said predetermined storage level.

14. The image forming apparatus according to claim 4, wherein said measurement pattern includes a plurality of measurement patterns used for different purposes.

15. The image forming apparatus according to claim 14, wherein said control unit disables said pattern forming unit such that at least one of said plurality of measurement patterns used for different purposes is not formed when said determination unit determines that said waste toner has reached said predetermined storage level.

16. The image forming apparatus according to claim 15, wherein said plurality of measurement patterns contain at least a pattern formed of a plurality of different tones for correcting a tone; and said control unit disables said pattern forming unit such that said pattern formed of said plurality of tones is not formed when said determination unit determines that said waste toner has reached said predetermined storage level.

17. The image forming apparatus according to claim 15, further comprising a setting unit that sets at least one measurement pattern of said plurality of measurement patterns.

18. The image forming apparatus according to claim 1, further comprising a display unit which displays an execution of said control of suppressing generation of said waste toner.

19. The image forming apparatus according to claim 1, further comprising a detection unit which detects that said waste toner has reached a maximum storage level, wherein said control unit stops an image forming operation when said detection unit detects that said waste toner has reached said maximum storage level.

20. The image forming apparatus according to claim 1, further comprising a switching unit that is configured to turn the control of said waste toner on and off when said determination unit determines that said waste toner has reached said predetermined storage level.

* * * * *